US005904115A

United States Patent [19]

Durbin et al.

[11] Patent Number: 5,904,115

[45] Date of Patent: May 18, 1999

[54] CLEARANCE POLE ASSEMBLY

[75] Inventors: Michael Wayne Durbin; Michael J. Winn, both of Louisville, Ky.

[73] Assignee: Lincoln Industries Division of Progress Rail Services, Louisville, Ky.

[21] Appl. No.: 08/733,780

[22] Filed: Oct. 18, 1996

[51] Int. Cl.[6] ..... E01F 13/00

[52] U.S. Cl. ..... 116/28 R; 116/63 R; 40/606; 40/608; 49/49; 49/337; 248/900

[58] Field of Search ..... 116/173–175, 63 P, 116/63 R, 28 R; 248/548, 900; 40/606, 608; 49/49, 236, 337, 239

[56] References Cited

U.S. PATENT DOCUMENTS

| | | | |
|---|---|---|---|
| 184,555 | 11/1876 | Gates | 49/239 |
| 1,491,636 | 4/1924 | Sanfacon | 116/28 R |
| 1,753,506 | 4/1930 | Florine | 49/239 |
| 1,759,314 | 5/1930 | Kinquist | 248/900 |
| 2,562,021 | 7/1951 | Dotten | 49/239 |
| 3,792,679 | 2/1974 | Duckett et al. . | |
| 3,847,497 | 11/1974 | Guillory, Sr. . | |
| 4,091,502 | 5/1978 | Little | 16/273 |
| 4,205,472 | 6/1980 | Shirley . | |
| 4,346,666 | 8/1982 | Iso . | |
| 4,737,048 | 4/1988 | Herrstrom . | |
| 5,230,296 | 7/1993 | Giltz et al. . | |
| 5,231,392 | 7/1993 | Gust . | |
| 5,277,146 | 1/1994 | Hughes, Jr. . | |
| 5,383,420 | 1/1995 | Dundorf | 116/174 |
| 5,474,016 | 12/1995 | Haney . | |
| 5,507,245 | 4/1996 | Kennedy . | |
| 5,555,631 | 9/1996 | Houston | 33/31 |

*Primary Examiner*—Andrew Hirshfeld
*Attorney, Agent, or Firm*—Nixon & Vanderhye P.C.

[57] ABSTRACT

An assembly, preferably comprising a clearance pole, includes a first pole element with a first horizontal portion and a second vertical portion, and a second tubular pole element mounted to the ground, extending vertically, and receiving the first pole second portion. The first and second pole elements are mounted so that the first element is rotatable with respect to the second about a vertical axis. The slanted surface of an ultra-high molecular weight polyethylene block acts as a cam follower engaging a rod, bar, or tube which acts as a cam, the structures biasing the first pole element first portion to a home position. A dry lubricant is provided between the pole element bearing surfaces to provide relatively friction-free rotation between them.

20 Claims, 5 Drawing Sheets

CLEARANCE POLE ASSEMBLY

BACKGROUND AND SUMMARY OF THE INVENTION

Pole assemblies can be used for a wide variety of purposes, such as mounting signs on roadways (see U.S. Pat. No. 4,205,472), for traffic direction purposes (see U.S. Pat. No. 4,346,666), as a parking aid (such as shown in U.S. Pat. No. 5,231,392), or for clearance poles (such as shown in U.S. Pat. No. 5,474,016). For many of these pole assemblies it is desirable to have one pole element rotatable with respect to another pole element with a structure for biasing the elements to a home position. Usually biasing is provided by springs which may have hydraulic dampers. The return biasing means often can be more complicated than desired. Also, unless particularly low friction bearing elements are provided for allowing relative rotation between the pole elements, a poorly operating structure may be the result.

According to the present invention a pole assembly is provided which may have a wide variety of uses. The pole assembly is characterized by a secure construction which has relatively friction-free movement between elements thereof, and is versatile, being utilizable for a wide variety of purposes. However the most advantageous utilization of the pole assembly according to the invention is as a clearance pole, for example in drive-in restaurants or the like where it is necessary to provide a positive indication to vehicles having a height greater than a predetermined amount that they should proceed no further, yet damage is not done to the pole assembly. It is desirable that the pole assembly according to the invention comprise a clearance assembly having a yielding horizontal portion and a vertical support, the horizontal portion mounted above the ground a predetermined clearance height by the vertical support, the clearance height indicating the maximum height that a vehicle should have to attempt to move therepast. The construction according to the invention does not require any mounting structure above the horizontal clearance pole element. In the construction according to the invention the horizontal clearance element returns to a home position utilizing a simple, reliable, and effective structure.

According to one aspect of the present invention a pole assembly is provided comprising the following components: A first pole element having a first portion elongated in a first dimension. A second pole element elongated in a second dimension. The first and second pole elements mounted to each other so that the first dimension is substantially perpendicular to the second dimension, and so that the first pole element is rotatable with respect to the second pole element about an axis substantially coincident with the second dimension. And, a cam mounted to one of the first pole element and the second pole element. And, a cam follower mounted to the other of the first pole element and the second pole element, and engaging the cam. And, means for biasing the cam and the cam follower into engagement with each other so that upon rotation of the first pole element about the axis the cam and cam follower are maintained in engagement with each other.

The assembly may further comprise cooperating stops associated with the cam and the cam followers for stopping relative rotation of the first and second pole elements with respect to each other after a predetermined amount of relative rotation between them. The stops may be positioned so that rotation of the first and second pole elements is stopped after about 90° relative rotation with respect to each other in either a clockwise or a counter-clockwise direction.

The cam and cam follower have an initial (home) position and the biasing means biases the cam and the cam follower into the initial position.

The first pole element preferably includes a second portion elongated in the second dimension, and mounted so that it is substantially concentric with a second pole element, and the biasing means preferably comprises means for stationarily mounting the second pole element so that the second dimension is substantially vertical so that gravity biases the cam and cam follower into engagement with each other, and so that the first dimension is substantially horizontal. Alternatively the biasing means may comprise a wide variety of conventional spring elements, or hydraulic or pneumatic cylinders.

Preferably a dry lubricant is provided between the second element and the second portion of the first element to provide relatively friction free rotation thereof with respect to each other. The cam follower preferably comprises a block of material having an angled face making an angle of between about 30–70° with respect to the second dimension, the angled face directly engaging the cam. The cam may comprise a rod, tube or bar having an desired cross-section, but preferably being substantially circular in cross-section and extending substantially perpendicular to the second dimension and having an exterior surface. The exterior surface is engaged by the angled face. Preferably the block of material is of, or the angled face has an edge engaging the cam that is coated with, a low friction material. Preferably the block is ultra-high molecular weight polyethylene. Preferably the cam follower is stationarily mounted to the first pole element second portion, and the cam is stationarily mounted to the second pole element. The first pole element first portion is preferably positioned above the ground a predetermined clearance height indicating the maximum height that a vehicle should have to attempt to move past it.

According to another aspect of the present invention a clearance pole assembly is provided comprising the following components: A first pole element having a first, substantially horizontal, portion, and a second, substantially vertical portion. A second, tubular, pole element stationarily mounted to the ground and extending substantially vertically and receiving the first pole element second portion therein and mounting the first pole element first, substantially horizontal, portion above the ground a predetermined clearance height indicating the maximum height that a vehicle should have to attempt to move therepast. The first and second pole elements mounted so that the first element is rotatable with respect to the second element about a substantially vertical axis substantially concentric with the second pole element. And, return means for returning first and second pole elements to a home position with respect to each other, while allowing rotation of the pole elements with respect to each other from the home position, the return means comprising a cam stationarily mounted to the second pole element and a cam follower stationarily mounted to the first pole element second portion, gravity biasing the cam follower into contact with the cam.

The details of the components, and their particular construction, preferably is as set forth above.

According to yet another aspect of the present invention a clearance pole assembly is provided comprising the following components: A first pole element having a first, substantially horizontal, portion, and a second, substantially vertical, tubular portion, the first portion having clearance indicia thereon. A second, tubular, pole element stationarily mounted to the ground and extending substantially vertically and receiving the first pole element second tubular portion therein and mounting the first pole element first, substantially horizontal, portion above the ground a predetermined clearance height indicating the maximum height that a vehicle should have to attempt to move therepast. The first and second pole elements mounted so that the first element is rotatable with respect to the second element about a substantially vertical axis substantially concentric with the second pole element. A tubular extension of the first pole element first portion, extending downwardly therefrom and having a lower surface. The second, tubular, pole element having an upper surface which mates with the lower surface of the tubular extension, an interface provided between the upper and lower surfaces. A collar fixed to the tubular extension and extending downwardly therefrom and exteriorly concentric with the second pole element, the collar covering said interface. The first and second pole elements have bearing surfaces engaging each other, including distinct bearing surfaces that are vertically spaced from each other. And, a dry lubricant disposed on the bearing surfaces for facilitating low friction rotation of the first pole element second portion with respect to the second pole element about the axis.

It is the primary object of the present invention to provide a simple and effective pole assembly, desirably one that is effective as a clearance pole assembly. This and other objects of the invention will become clear from an inspection of the detailed description of the invention and from the appended claims.

DETAILED DESCRIPTION OF THE DRAWINGS

Figure 1:
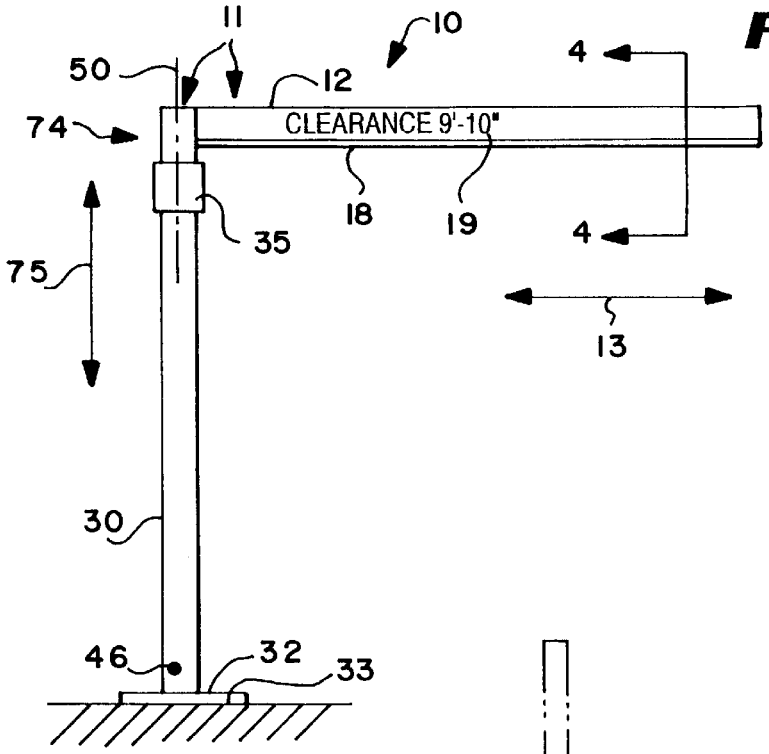
FIG. 1 is a side view of an exemplary clearance pole assembly according to the present invention.
Figure 2:
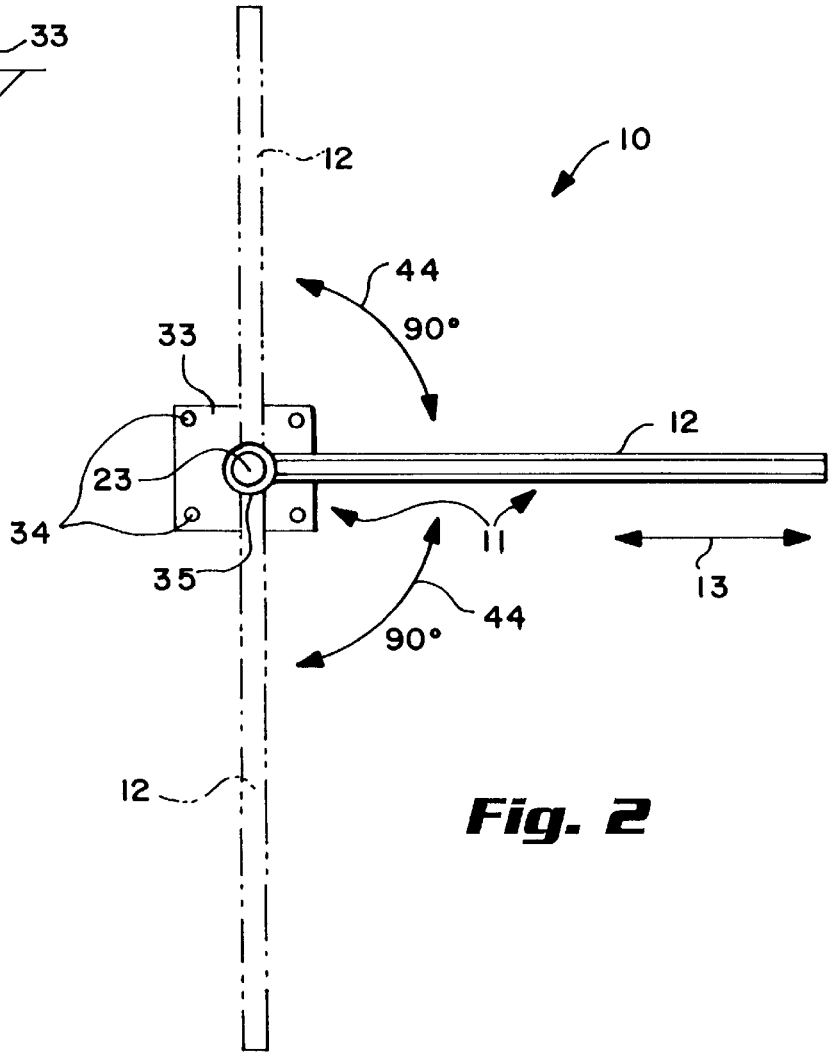
FIG. 2 is a top plan view of the assembly of FIG. 1.
Figure 3:
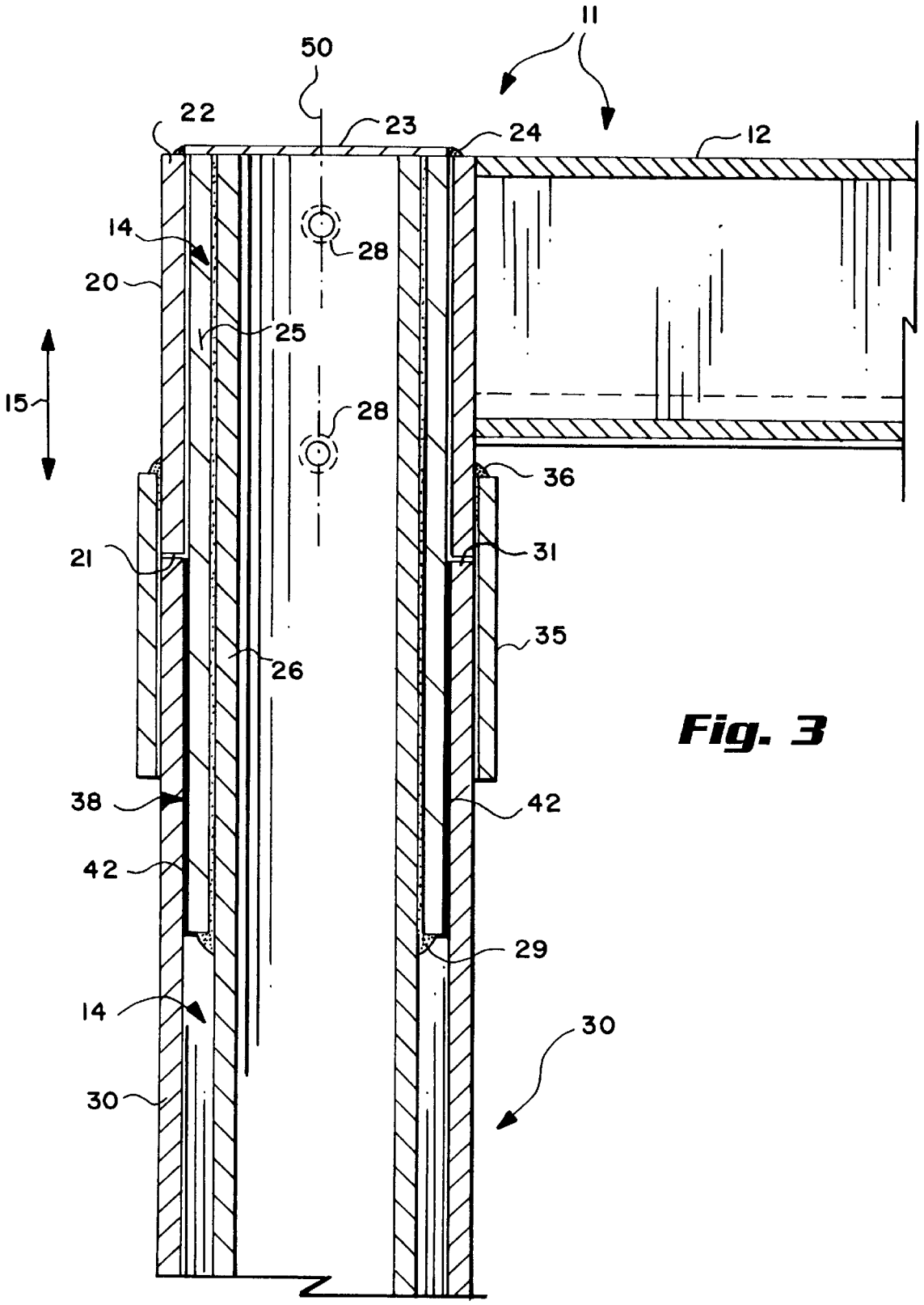
FIG. 3 is a top detail cross-sectional view at the interface between the horizontal and vertical components of the pole assembly of FIGS. 1 and 2.

An exemplary pole assembly according to the present invention is shown generally by reference numeral 10 in FIGS. 1 through 3. The assembly 10 includes a first rigid pole element, shown generally by reference numeral 11 in FIGS. 1 through 3 which preferably includes a first portion 12 that is elongated in the first dimension 13, in the preferred embodiment of the invention the dimension 13 preferably being horizontal. The first pole element 11 also preferably comprises a second portion, shown generally by reference numeral 14 in FIGS. 1 and 3, elongated in a second dimension 15 substantially perpendicular to the first dimension 13. In the preferred embodiment of the assembly 10, as illustrated in FIGS. 1 and 2, the dimension 15 is substantially vertical.

Figure 4:
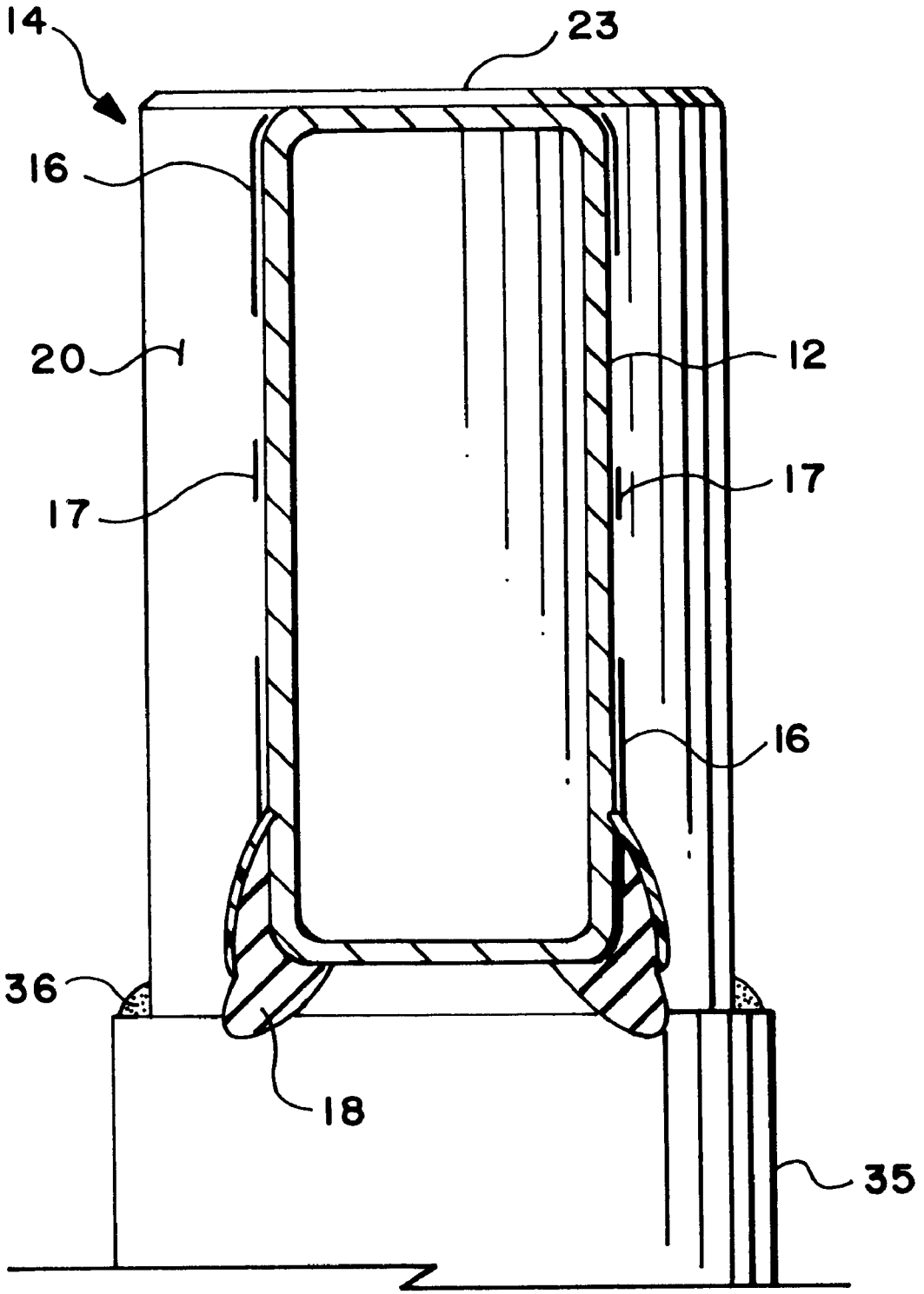
FIG. 4 is a cross-sectional view taken along lines 4—4 of FIG. 1.

While the first pole element 11 first portion 12 may have a wide variety of different configurations, one preferred configuration which is seen most clearly by a comparison of FIGS. 1, 2, and 4 is a polygonal cross-section (see FIG. 4 in particular) including substantially vertical and planar side faces 17 which preferably include indicia such as the clearance indicia 19 illustrated in FIG. 1. The first portion 12 may be connected to the second portion 14 by welding, adhesive, a mating joint, fasteners, or any other suitable conventional structure (e.g. by weld 16 illustrated in FIG. 4). The lip molding 18 is provided at the bottom of each of the faces 17 to provide a resilient material (e.g. rubber) guard at the bottom of the portion 12 which is impacted by vehicles that are too tall without significantly damaging the vehicles or the arm 12. Indicia 19 may be provided on faces 17.

The second portion 14 of the first pole 11 preferably has the construction illustrated most clearly in FIG. 3, namely a top pipe section 20 (e.g. four inch SCH 40 black pipe, ASTM A53) which is actually attached to the first portion 12. The tube 20 has a lower surface 21, and a top surface 22 to which a mild steel sheet metal disc 23 is connected, such as by welding 24. Interior of the tube 20 is a second tube 25 (e.g. 3½ inch outside diameter SCH 40 black pipe, ASTM A53), and interior thereof an inner concentric tube 26 (e.g. three inch outside diameter SCH 40 black pipe, ASTM A53). The tubes 20, 25, 26 are connected together, such as by a plurality of stainless steel counter sunk bolts 28. Various components of the first pole element 11 second portion 14 may be further affixed together by welding, such as shown by weld 29.

The pole assembly 10 further comprises a second rigid pole element shown generally by reference numeral 30, the second pole element 30 also elongated in the second dimension 15 (that is extending substantially vertically). The second pole element 30 may comprise a four inch SCH 40 black pipe, ASTM A53, and has a top surface 31 adjacent the bottom surface 21 of the portion 14, and at the bottom 32 thereof (see FIG. 1) is connected, as indicated schematically by the structure 33 in FIG. 1, to the ground. Any suitable secure connection to the ground may be provided, such as by bolting 34 (see FIG. 2) the connection 33 to the concrete foundation, sinking the bottom of the tubular element 30 into the ground or concrete itself, or in any other conventional manner.

The second portion 14 of the first pole element 11 is received within the tubular second pole element 30, being substantially concentric therewith. The interface between the surfaces 21, 31 is covered by a collar 35 which is fixed—such as welding 36—to the tubular extension 20 of the first portion 12 of the first element 11, as seen in FIG. 3.

Figure 5:
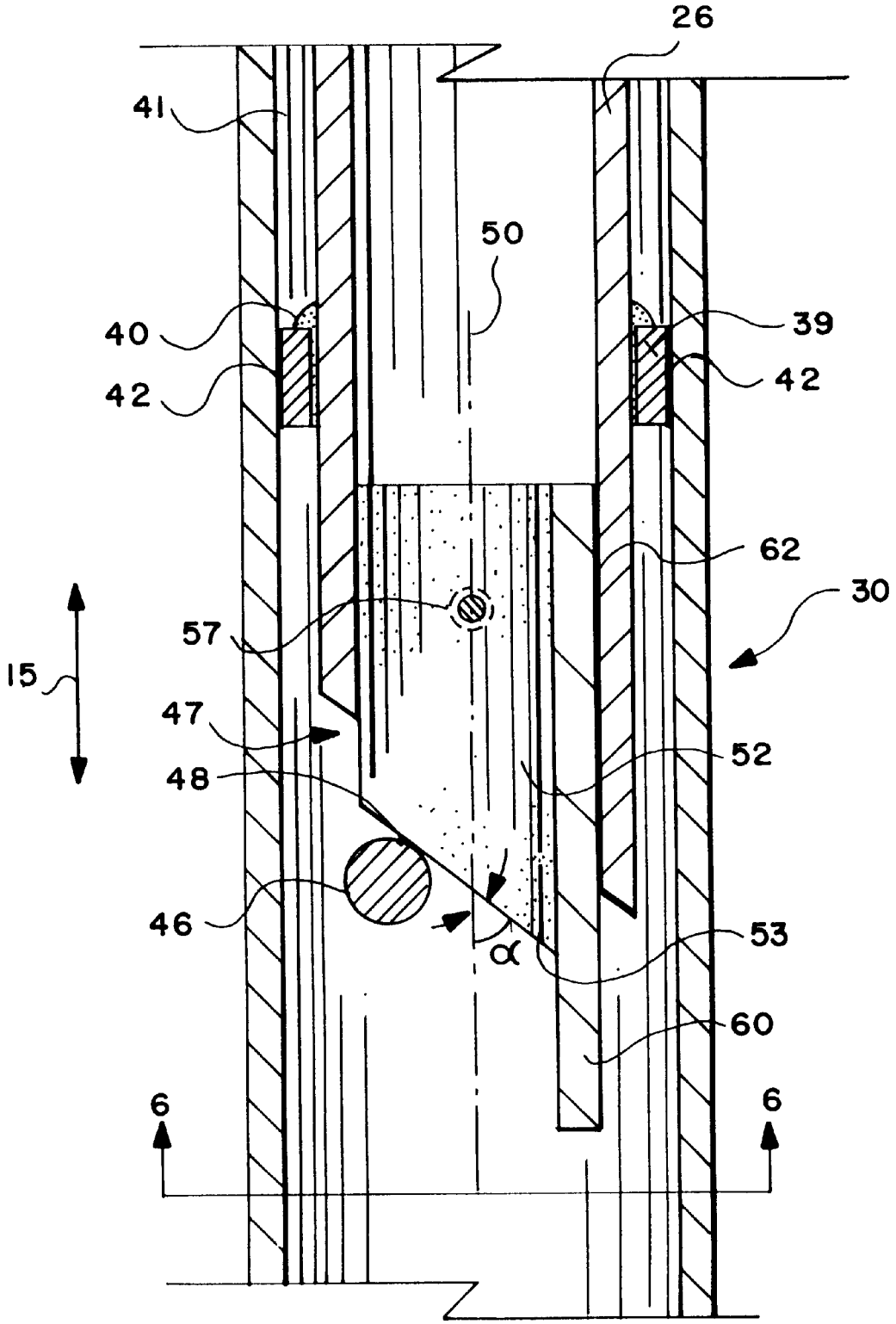
FIG. 5 is a detail cross-sectional view, partly in elevation, taken at and just above reference numeral 46.

The first and second pole elements 11, 30 also have bearing surfaces engaging each other. Preferably the bearing surfaces include vertically spaced elements. For example as seen in FIGS. 3 and 5, a first bearing surface—shown generally at reference numeral 38—is provided by the exterior surface of the pipe 25 and the interior surface of the tubular second pole element 30 for a distance of several inches from the interface between the surfaces 21, 31. A second bearing surface is provided by the exterior of the annular ring 39 and the inner surface of the tubular second pole element 30 at the position illustrated in FIG. 5.

The ring 39 may be cut from a 3½ inch outside diameter SCH 40 black pipe, ASTM A53. The ring 39 is attached (e.g. welded)—as indicated at 40 in FIG. 5—to the pipe 26 which is part of the second portion 14 of the first pole element 11. Other bearing surfaces, such as other rings 39, may also be provided along the length of the components 26, 30 at various vertically spaced positions within the annular opening 41 (see FIG. 5).

In order to provide relatively friction-free rotation between the components 26, 30, it is desired that the bearing surfaces include some sort of friction-free material. For example the components 25, 39 could be made of low friction material such as polytetrafluoroethylene, or could have a polytetrafluoroethylene exterior coating, and/or the interior surface of the component 30 could be coated with polytetrafluoroethylene at desired locations. However desirably the low friction nature is provided by a dry lubricant at the actual bearing surfaces, for example as seen schematically in FIGS. 3 and 5 at 42. One exemplary form that the dry lubricant 42 can take is an aerosol spray of Dow Corning 321 Dry Film Lubricant, which may be sprayed on the exterior surfaces of the components 25, 39 and/or on the interior surface of the component 30 where the bearing means 38 are provided, although it is much easier to spray the lubricant on only the exterior surfaces of the components 25, 39. Exemplary constituents of this dry film lubricant are approximately (by weight) 48% sweetened liquefied petroleum gas, 3% graphite, 5% polybutyl titanate, 9% molybdenum disulfide, 34% Stoddard solvent (#1736), and 1% inert components or fractions of the above components.

The assembly 10 further comprises return means for returning the first and second pole elements 11, 14 to a home position (the position illustrated in FIGS. 1 and 2) with respect to the other while allowing rotation of the pole elements 11, 14 with respect to each other from the home position, as indicated by the 90° arc arrows 44 and the dotted line positions of the portion 12 seen in FIG. 2. While the return means may comprise conventional spring arrangements, including arms or hooks for mounting the springs, and springs of almost any type including torsion, coil, and leaf springs, in the preferred embodiment the return means comprises a cam and a cam follower which are gravity biased into contact with each other so that gravity acts as a biasing means. While the cam and the cam follower may have a number of different configurations depending upon their orientation, materials, and positions, a particularly desirable construction thereof is illustrated most clearly in FIGS. 5 through 7.

Figure 6:
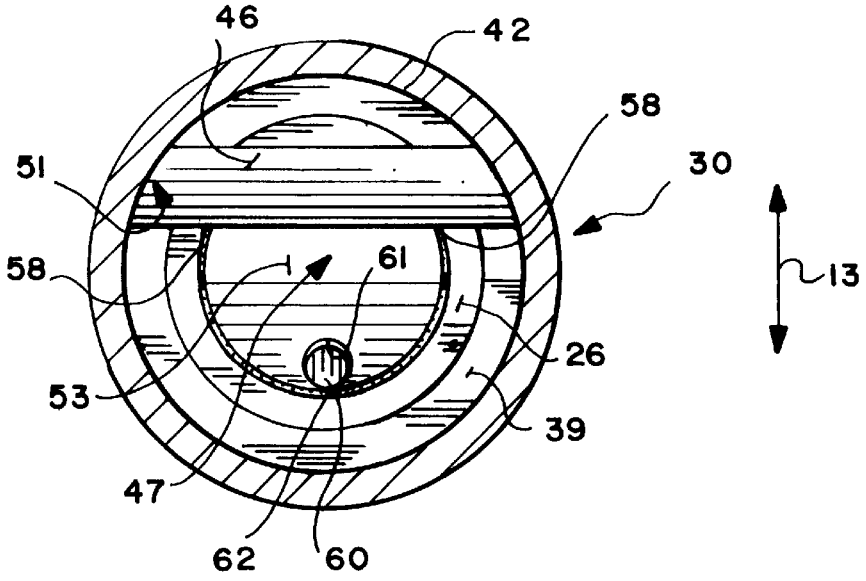
FIG. 6 is a cross-sectional view taken along arrows 6—6 of FIG. 5.
Figure 7:
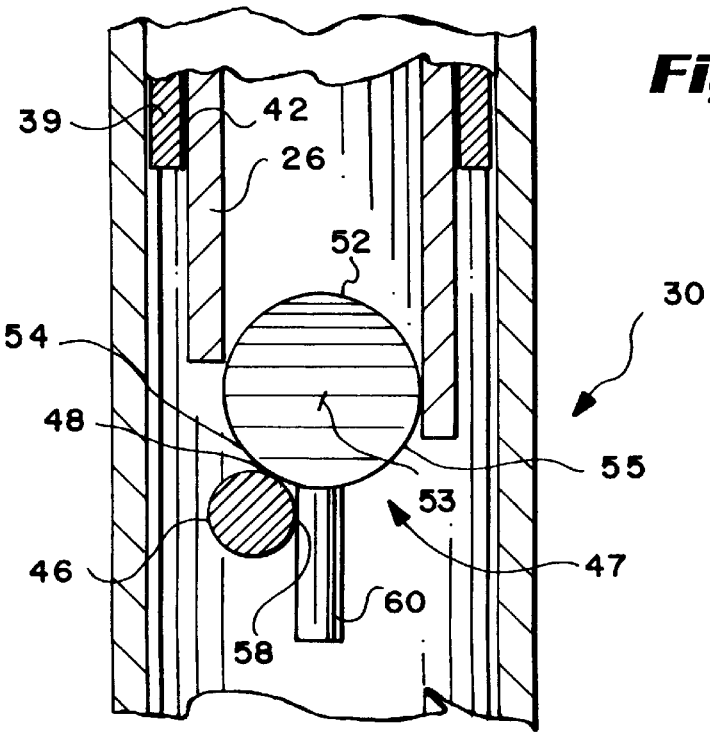
FIG. 7 is a view like that of FIG. 5 only showing the first element rotated 90° with respect to the position illustrated in FIG. 5.

In the embodiment of FIGS. 5 through 7 the cam is shown generally by reference numeral 46 while the cam follower is shown generally by reference numeral 47. One of the elements 46, 47 is mounted to a second pole element 30, while the other is mounted to the component 26 of the second portion 14 of the first pole element 11. In the preferred embodiment illustrated in FIGS. 5 through 7 the cam 46 is stationarily mounted to the component 30, while the cam follower 47 is stationarily mounted (and for rotation with) the element 26.

The cam 46 may have a wide variety of configurations, the only requirement being that it have a relatively rigid exterior surface portion 48 that can properly cooperate with the cam follower 47. For example the cam 46 may be a bar, rod, or tube of metal such as a three-quarter inch diameter steel circular cross-section hot rolled rod, ASTM A576, extending perpendicular to the dimension 15 and preferably also perpendicular to the dimension 13. The cam 46 is horizontally spaced from the substantially vertical axis of rotation 50 of the pole element 11 with respect to the pole element 30; e.g. for the embodiment illustrated in FIG. 5 the center of the cam 46 is horizontally spaced (in dimension 14) about three-quarters of an inch from the axis 50. Cam 46 is anchored in the walls of the component 30, as illustrated schematically at 51 in FIG. 6, and may be permanently affixed thereto as by welding, or may be releasably affixed thereto as by providing an interference fit between the cam 46 and bores (not shown) in the walls of the component 30, or bolts providing the ends of the cam 46 threaded and nuts releasably holding the ends in place.

The cam follower 47 preferably comprises a block of material 52 having an angled face 53. The face 53 makes an angle $\alpha$ (see FIG. 5) with respect to the vertical axis 50. While the angle $\alpha$ may vary widely depending upon the particular materials utilized in extent of rotation of the element 11 with respect to the element 30 desired, preferably the angle $\alpha$ is between about 30–70°, e.g. about 50° in the embodiment illustrated in FIG. 5. The block 52 at the angled face 53 has at least one edge 54 thereof (see FIG. 7) that directly engages the surface 48 of the cam 46, the surface 48 being below the edge 54 of the cam follower 47. Preferably the assembly 10 is bi-directional, that is can rotate in the directions of both of the arrows 44 in FIG. 2, the cam follower 47 being substantially symmetrical, including having symmetrical edges 54, 55 capable of cooperating with the surface 47.

While the block 52 may be a wide variety of materials, preferably the entire block 52, or at least the edges 54, 55 thereof, are of a relatively low friction material. While TEFLON® may be used as such a material as a coating for the edges 54, 55, where the entire block 52 is to be made of the same material preferably the material is an ultra-high molecular weight polyethylene $[(CH_2—CH_2)_n]$ such as sold under the trade name TIVAR available from the Poly Hi Solidur Division of Menasha Corporation of Fort Wayne, Ind. having a specific gravity of about 0.93–0.94. Block 52 is securely mounted to the component 26 for rotation therewith, such as by one or more one-quarter inch zinc plated counter sink bolts 57 (see FIG. 5).

The assembly 10 also preferably comprises cooperating stops associated with the cam 46 and cam follower 47 for stopping relative rotation of the pole elements 11, 30 with respect to each other after a predetermined amount of relative rotation therebetween (e.g. after about 90° relative rotation—see reference numerals 44 in FIG. 2—in each a clockwise or counter-clockwise direction). While the stops may take a variety of different configurations, in the preferred embodiment illustrated in FIGS. 5 through 7 the stops comprise a portion of the exterior surface of the bar, rod, or tube forming the cam 46 (such as surface portion 58 illustrated in FIGS. 6 and 7), and a stop element 60 extending outwardly, and downwardly, from the angled face 53, the element 60 being spaced in the horizontal dimension 13 from the axis of rotation 50 on the opposite side of the axis 50 from the cam 46, as seen most clearly in FIG. 5. While the element 60 may have a wide variety of configurations in the embodiment illustrated in FIGS. 5 through 7 it comprises a one-half inch diameter steel rod of circular cross-section, hot rolled, ASTM A576. It fits in a cavity 61 formed in the polyethylene block 52 (see FIG. 6) and is secured to the component 26 for rotation therewith as by a weld 62 (see FIGS. 5 and 6).

FIGS. 5 and 6 show the cam and cam follower 46, 47 in the home position, while FIG. 7 shows them in a position approximately 90° from that illustrated in FIG. 5 where the stop element 60 engages the stop surface 58 of the cam 46.

Note that gravity automatically returns the cam follower 47 from the position illustrated in FIG. 7 to that illustrated in FIG. 5 once the force causing rotation of the pole element 11 is removed, the return action thus being independent of any springs, pneumatic or hydraulic cylinders, or like biasing or return means and the components providing the return action being mounted within the components 26, 30 so that they are protected from the outside environment and are of a sturdy and long lasting construction.

While the assembly 10 may be used for a wide variety of functions depending upon the relative orientations, dimensions, and constructions of the components thereof, in the preferred embodiment the assembly 10 comprises a clearance pole assembly. For this particular embodiment the normal method of construction and use will be described.

The rectangular tubing forming the portion 12 is welded as indicated at 16 to the tubular extension 20 of the first pole element 11 first portion 12 and the rubber guards/molding 18 are installed as seen in FIG. 4. The tubes 25, 26 are assembled with the tubular extension 20 and are fastened in place using the counter sunk bolts 28 as seen in FIG. 3, and then disc cap 23 is placed on the top of components 20, 25, 26 (as seen in FIG. 3) and affixed in place as by the weld 24. The collar 35 is slipped over the exterior bottom of the tubular extension 20 and is affixed in place as by the weld 36. One or more bearing rings 39 are also affixed, as by weld 40 (see FIG. 5) at spaced vertical locations along the pipe 26 from the pipe 25, and the exterior surfaces of the bearing elements that are provided—namely the exterior surface of the pipe 25 below the tubular extension 20, and the exterior surface of the ring 39—are sprayed with a dry film lubricant, such as Dow Corning 321.

The second pole element 30 is securely mounted in the ground, as by using mount 33, so that it extends substantially vertically.

The entire pole element 11 is then inserted into operative association with the second pole element 30, the lubricant 42 surface of the ring 39 engaging the inner surface of the tubular component 30 and sliding downwardly until the cam follower 47 face 53 engages the surface 48 of the cam 46 which is stationarily mounted in the component 30, the cam follower 47 having been previously mounted in place at the bottom of the tube 26 by one or more counter sink bolts 57 and the weld 62 between the stop element 60 and the inner surface of the tube 26. Care is taken when installing the pole element 30 that the cam 46 extends horizontally in a dimension perpendicular to the dimension 13 and so that the dimension 13 is perpendicular to the vehicle path that the assembly 10 is associated with. When the elements 46, 47 have the relative position illustrated in FIG. 5 the surfaces 21, 31 are almost in engagement with each other, or can even touch.

If a vehicle approaches the assembly 10 that has a height higher than the clearance height defined by the assembly 10 (e.g. 9 feet, 10 inches in the embodiment illustrated in FIG. 1 which includes the indicia 19), then the vehicle will engage—at the lip molding 18—the portion 12 and pivot it in the direction of the top arrow 44 in FIG. 2, the components 12, 20, 25, 26 on the one hand rotating about the axis 50 with respect to the component 30 on the other hand, with relatively friction free rotation being provided by the dry film lubricant 42 at the bearing surfaces 38. This relative rotation causes the edge 54 of the block 52 to engage the surface 48 of the cam 46, lifting the first pole element 11 slightly as rotation occurs. Engagement between the stop element 60 and the stop surface 58 of the cam 46 stops this relative rotation after about 90° (see the upper dotted line configuration of the portion 12 in FIG. 2 and the stop position illustrated in FIG. 7).

When the force causing the rotation about the axis 50 is removed (as by the vehicle backing up away from the assembly 10) the force of gravity provides a biasing force on the cam follower 47 causing the edge 54 and surface 48 to engage as the elements 11, 30 again rotate with respect to each other from the stop position illustrated in FIG. 7 to the home position illustrated in FIG. 5. The biasing action provided is almost fail-safe and the components are sturdy and long lived. Also the return means provided by the cam and cam follower 46, 47 is protected from the elements. Of course the clearance height may be adjusted merely by adjusting the length of the second pole element 30, the length of the tube 26 being adjusted to be proportional thereto.

It will thus be seen that according to the present invention a highly desirable pole assembly, particularly a clearance pole assembly, has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A pole assembly comprising:

a first pole element having a first portion elongated in a first dimension;

a second pole element elongated in a second dimension;

said first and second pole elements mounted to each other so that said first dimension is substantially perpendicular to said second dimension, and so that said first pole element is rotatable with respect to said second pole element about an axis substantially coincident with said second dimension;

a cam mounted to one of said first pole element and said second pole element;

a cam follower mounted to the other of said first pole element and said second pole element, and engaging said cam, said cam follower comprising a block of material mounted internally of and extending radially across said other of said pole elements, and distinct therefrom;

means for biasing said cam and said cam follower into engagement with each other so that upon rotation of said first pole element about said axis said cam and cam follower are maintained in engagement with each other; and wherein said first pole element is positioned above the ground a predetermined clearance height indicating the maximum height that a vehicle should have to attempt to move therepast, and has clearance indicia thereon.

2. An assembly as recited in claim 1 further comprising cooperating stops associated with said cam and said cam follower for stopping relative rotation of said first and second pole elements with respect to each other after a predetermined amount of relative rotation therebetween.

3. An assembly as recited in claim 2 wherein said stops are positioned so that rotation of said first and second pole elements is stopped after about 90° relative rotation with respect to each other in both a clockwise and counterclockwise direction.

4. An assembly as recited in claim 1 wherein said cam and cam follower have an initial position; and wherein said biasing means bias said cam and said cam follower into said initial position.

5. An assembly as recited in claim 4 wherein said first pole element includes a second portion elongated in said second dimension, and mounted so that it is substantially concentric with said second pole element; and wherein said biasing means comprises means for stationarily mounting said second pole element so that said second dimension is substantially vertical so that gravity biases said cam and said cam follower into engagement with each other, and so that said first dimension is substantially horizontal.

6. An assembly as recited in claim 5 further comprising dry lubricant operatively provided between said second element and said second portion of said first element to provide relatively friction free rotation thereof with respect to each other.

7. An assembly as recited in claim 5 wherein said block of material has an angled face making an angle of between about 30–70° with respect to said second dimension, said angled face directly engaging said cam.

8. An assembly as recited in claim 7 wherein said cam comprises a bar, rod or tube extending substantially perpendicular to said second dimension, and having an exterior surface, said exterior surface engaged by said angled face.

9. An assembly as recited in claim 7 wherein said block of material is of, or said angled face has an edge engaging said cam that is coated with, a low friction material.

10. An assembly as recited in claim 5 wherein said cam follower is stationarily mounted to said first pole element second portion, and said cam is stationarily mounted to said second pole element.

11. A clearance pole assembly comprising:

a first pole element having a first, substantially horizontal, portion, and a second, substantially vertical portion;

a second, tubular, pole element stationarily mounted to the ground and extending substantially vertically and receiving said first pole element second portion therein and mounting said first pole element first, substantially horizontal, portion above the ground a predetermined clearance height indicating the maximum height that a vehicle should have to attempt to move therepast;

said first and second pole elements mounted so that said first element is rotatable with respect to said second element about a substantially vertical axis substantially concentric with said second pole element; and return means for returning said first and second pole elements to a home position with respect to each other, while allowing rotation of said pole elements with respect to each other from said home position, said return means comprising a cam stationarily mounted to said second pole element and a cam follower stationarily mounted to said first pole element second portion, gravity biasing said cam follower into contact with said cam, said cam comprising a substantially circular cross section rod or tube extending substantially perpendicular to the vertical portion, and having an exterior surface engaged by said cam.

12. A clearance pole assembly as recited in claim 11 wherein said cam follower comprises a block of material having an angled face making an angle of between about 30–70° with respect to the vertical, said angled face having at least an edge directly engaging a surface of said cam, and said cam surface being engaged by said cam follower disposed below said edge of said cam follower.

13. A clearance pole assembly as recited in claim 12 wherein said first and second pole elements have bearing surfaces engaging each other; and further comprising a dry lubricant disposed on said bearing surfaces for facilitating low friction rotation of said first pole element second portion with respect to said second pole element about said axis.

14. A clearance pole assembly comprising:

a first pole element having a first, substantially horizontal, portion, and a second, substantially vertical, tubular portion, said first portion having clearance indicia thereon;

a second, tubular, pole element stationarily mounted to the ground and extending substantially vertically and receiving said first pole element second tubular portion therein and mounting said first pole element first, substantially horizontal, portion above the ground a predetermined clearance height indicating the maximum height that a vehicle should have to attempt to move therepast;

said first and second pole elements mounted so that said first element is rotatable with respect to said second element about a substantially vertical axis substantially concentric with said second pole element and so that said first pole element is biased to a particular position with respect to said second pole element;

a tubular extension of said first pole element first portion, extending downwardly therefrom and having a lower surface;

said second, tubular, pole element having an upper surface which mates with said lower surface of said tubular extension, an interface provided between said upper and lower surfaces;

a collar fixed to said tubular extension and extending downwardly therefrom and exteriorly concentric with said second pole element, said collar covering said interface;

said first and second pole elements have bearing surfaces engaging each other, including distinct bearing surfaces that are vertically spaced from each other; and a dry lubricant disposed on said bearing surfaces for facilitating low friction rotation of said first pole element second portion with respect to said second pole element about said axis.

15. A pole assembly comprising:

a first pole element having a first portion elongated in a first dimension;

a second pole element elongated in a second dimension;

said first and second pole elements mounted to each other so that said first dimension is substantially perpendicular to said second dimension, and so that said first pole element is rotatable with respect to said second pole element about an axis substantially coincident with said second dimension;

a cam mounted to one of said first pole element and said second pole element;

a cam follower mounted to the other of said first pole element and said second pole element, and engaging said cam;

means for biasing said cam and said cam follower into engagement with each other so that upon rotation of said first pole element about said axis said cam and cam follower are maintained in engagement with each other;

said cam and cam follower having an initial position, and said biasing means biasing said cam and said cam follower into said initial position; and wherein said cam comprises a bar, rod or tube extending substantially perpendicular to said second dimension, and having an exterior surface, said exterior surface engaged by said cam.

16. An assembly as recited in claim 15 further comprising cooperating stops associated with said cam and said cam follower for stopping relative rotation of said first and second pole elements with respect to each other after a predetermined amount of relative rotation therebetween, said stops comprising a portion of said exterior surface of said bar, rod or tube, and a stop element extending outwardly from said cam substantially in said second dimension but spaced from said axis of rotation.

17. An assembly as recited in claim 16 wherein said stops are positioned so that rotation of said first and second pole elements is stopped after about 90° relative rotation with respect to each other in both a clockwise and counterclockwise direction.

18. A pole assembly comprising:

a first pole element having a first portion elongated in a first dimension;

a second pole element elongated in a second dimension;

said first and second pole elements mounted to each other so that said first dimension is substantially perpendicular to said second dimension, and so that said first pole element is rotatable with respect to said second pole element about an axis substantially coincident with said second dimension;

a cam mounted to one of said first pole element and said second pole element;

a cam follower mounted to the other of said first pole element and said second pole element, and engaging said cam;

means for biasing said cam and said cam follower into engagement with each other so that upon rotation of said first pole element about said axis said cam and cam follower are maintained in engagement with each other; wherein said cam and cam follower having an initial position, and said biasing means biasing said cam and said cam follower into said initial position; and wherein said cam follower comprises a block of material having an angled face making an angle of between about 30–70° with respect to said second dimension, said angled face directly engaging said cam, and wherein said block of material is of, or said angled face has an edge engaging said cam that is coated with, a low friction material, said block of material mounted internally of and extending radially across said other of said pole elements.

19. An assembly as recited in claim 18 wherein said block is of ultra-high molecular weight polyethylene.

20. An assembly as recited in claim 18 wherein said first pole element is positioned above the ground a predetermined clearance height indicating the maximum height that a vehicle should have to attempt to move therepast and has clearance indicia thereon.

* * * * *